US011162200B2

(12) United States Patent
Ngene et al.

(10) Patent No.: US 11,162,200 B2
(45) Date of Patent: Nov. 2, 2021

(54) EMBROIDERED ARTICLE

(71) Applicant: NIKE, Inc., Beaverton, OR (US)

(72) Inventors: David Ngene, Portland, OR (US); SH Park, Portland, OR (US); John Salzano, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 156 days.

(21) Appl. No.: 16/705,549

(22) Filed: Dec. 6, 2019

(65) Prior Publication Data

US 2020/0115835 A1 Apr. 16, 2020

Related U.S. Application Data

(63) Continuation of application No. 15/591,686, filed on May 10, 2017, now Pat. No. 10,508,373.

(60) Provisional application No. 62/336,346, filed on May 13, 2016.

(51) Int. Cl.

| | |
|---|---|
| ***D05C 17/00*** | (2006.01) |
| ***D04B 15/00*** | (2006.01) |
| ***A43B 1/04*** | (2006.01) |
| ***A43B 23/02*** | (2006.01) |

(52) U.S. Cl.

CPC ..... *D05C 17/00* (2013.01); *A43B 1/04* (2013.01); *A43B 23/0235* (2013.01); *A43B 23/0265* (2013.01); *A43B 23/0275* (2013.01); *D04B 15/00* (2013.01)

(58) Field of Classification Search

CPC ..... D05C 17/00; D04B 15/00; A43B 1/04; A43B 23/0235; A43B 23/0275; A43B 23/0265

See application file for complete search history.

(56) References Cited

U.S. PATENT DOCUMENTS

| | | | |
|---|---|---|---|
| 2,440,393 | A | 4/1948 | Clark |
| 2,608,078 | A | 8/1952 | Anderson |
| 2,641,004 | A | 6/1953 | Whiting et al. |

(Continued)

FOREIGN PATENT DOCUMENTS

| | | | |
|---|---|---|---|
| CN | 101632502 | A | 1/2010 |
| CN | 102318931 | A | 1/2012 |

(Continued)

OTHER PUBLICATIONS

EP Communication dated Dec. 20, 2018 for EP Application No. 17725061.0 (3 pages).

(Continued)

*Primary Examiner* — Ismael Izaguirre

(74) *Attorney, Agent, or Firm* — Shook, Hardy & Bacon, L.L.P.

(57) ABSTRACT

An article may include a base layer, which may be knitted, along with a first strand embroidered with the base layer at a first embroidered area. The first strand may include an elasticity that is less than an elasticity of the base layer, and the first strand may include a plurality of first lengths that extend in a first direction such that the first embroidered area of the article includes a first elasticity along the first direction. The first embroidered area of the article may include a second elasticity in a second direction, where the second direction is perpendicular to the first direction, and where the second elasticity is greater than the first elasticity.

20 Claims, 4 Drawing Sheets

(56) References Cited

U.S. PATENT DOCUMENTS

| | | | | |
|---|---|---|---|---|
| 3,202,153 | A * | 8/1965 | Sachs | A41C 3/00 450/59 |
| 3,463,692 | A | 8/1969 | Brunner | |
| 3,567,567 | A | 3/1971 | Sherrill | |
| 4,788,922 | A | 12/1988 | Clarius | |
| 5,345,638 | A | 9/1994 | Nishida | |
| 7,574,818 | B2 | 8/2009 | Meschter | |
| 7,637,032 | B2 | 12/2009 | Sokolowski et al. | |
| 7,770,307 | B2 | 8/2010 | Meschter | |
| 7,814,852 | B2 | 10/2010 | Meschter | |
| 7,870,681 | B2 | 1/2011 | Meschter | |
| 7,870,682 | B2 | 1/2011 | Meschter et al. | |
| 7,931,639 | B2 * | 4/2011 | Suga | A61F 13/72 604/396 |
| 8,132,340 | B2 | 3/2012 | Meschter | |
| 8,500,704 | B2 * | 8/2013 | Boehringer | A61F 13/36 604/313 |
| 8,959,959 | B1 | 2/2015 | Podhajny | |
| 2002/0072694 | A1 * | 6/2002 | Snitkin | A61L 31/10 602/4 |
| 2004/0118018 | A1 | 6/2004 | Dua | |
| 2004/0198178 | A1 * | 10/2004 | Mitchell | A41C 3/0014 450/66 |
| 2007/0031667 | A1 * | 2/2007 | Hook | D02G 3/24 428/373 |
| 2008/0154376 | A1 * | 6/2008 | Bergeron | A61F 2/442 623/17.16 |
| 2010/0037483 | A1 | 2/2010 | Meschter et al. | |
| 2010/0175276 | A1 | 7/2010 | Dojan et al. | |
| 2010/0199520 | A1 | 8/2010 | Dua et al. | |
| 2010/0251564 | A1 | 10/2010 | Meschter | |
| 2011/0041359 | A1 * | 2/2011 | Dojan | A43B 7/14 36/47 |
| 2014/0150292 | A1 | 6/2014 | Podhajny et al. | |
| 2014/0196190 | A1 * | 7/2014 | Brown | A41C 3/0057 2/69 |
| 2014/0245632 | A1 | 9/2014 | Podhajny et al. | |
| 2014/0273740 | A1 * | 9/2014 | Scott | A41C 3/0021 450/93 |
| 2015/0117241 | A1 | 4/2015 | Koc et al. | |
| 2015/0272274 | A1 | 10/2015 | Berns et al. | |
| 2015/0366504 | A1 * | 12/2015 | Connor | A61B 5/6804 600/301 |
| 2015/0374062 | A1 | 12/2015 | Ikenaka et al. | |

FOREIGN PATENT DOCUMENTS

| | | | |
|---|---|---|---|
| CN | 102497793 | A | 6/2012 |
| CN | 103717795 | A | 4/2014 |
| CN | 102548442 | B | 1/2015 |
| CN | 102497792 | B | 8/2015 |
| CN | 105411079 | A | 3/2016 |
| KR | 10-2015-0117241 | A | 10/2015 |
| TW | 185986 | | 12/1980 |
| TW | 201031784 | A1 | 9/2010 |
| TW | I352143 | | 11/2011 |
| TW | M481626 | U | 7/2014 |
| WO | WO 92/2223 | A1 | 12/1992 |
| WO | WO 2007/139567 | A1 | 12/2007 |

OTHER PUBLICATIONS

International Preliminary Report on Patentability and Written Opinion for PCT Application No. PCT/US2017/032074 dated Nov. 13, 2018 (7 pg.).

International Search Report and Written Opinion for PCT Application No. PCT/US2017/032074 dated Sep. 18, 2017 (7 pg.).

Office Action, and English translation thereof, in corresponding Taiwan Application No. 106115902, dated Aug. 20, 2018.

Office Action and English Translation in corresponding Chinese Application No. 2017800293184, dated Aug. 13, 2020 (8 pages).

Office Action and English Translation in Corresponding Taiwanese Application No. 108145755, dated Oct. 28, 2020 (4 pages).

Office Action and English Translation in Corresponding Taiwanese Application No. 106115902, dated Oct. 27, 2020 (7 pages).

Non-Final Office Action received for U.S. Appl. No. 15/591,686, dated Apr. 25, 2019, 10 pages.

Notice of Allowance received for U.S. Appl. No. 15/591,686, dated Aug. 13, 2019, 5 pages.

* cited by examiner

FIG. 5
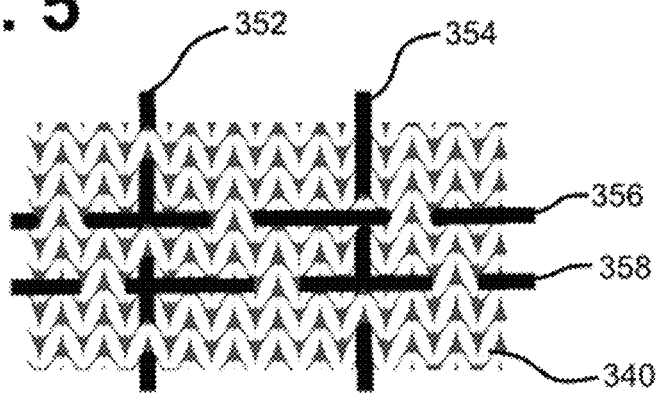
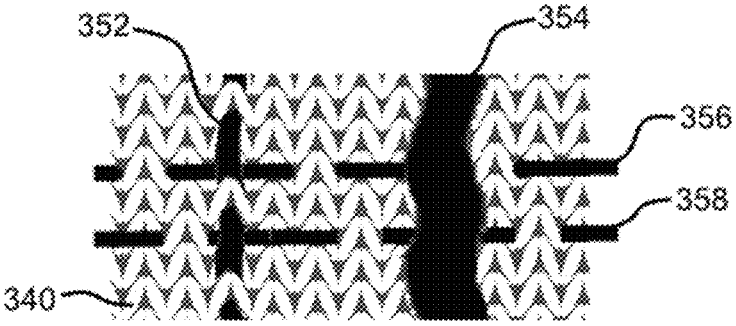
FIG. 6

EMBROIDERED ARTICLE

CROSS-REFERENCE TO RELATED APPLICATIONS

This application is a continuation of U.S. patent application Ser. No. 15/591,686, filed May 10, 2017, and entitled "EMBROIDERED ARTICLE," which claims priority to U.S. Provisional Application Ser. No. 62/336,346, filed May 13, 2016. All applications listed in this paragraph are hereby incorporated by reference in their entireties.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Conventional articles of footwear generally include two primary elements: an upper and a sole structure. The upper typically is secured to the sole structure and forms a void within the article of footwear for comfortably and securely receiving a foot. The sole structure typically is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and forms a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate a heel counter to limit movement of the heel.

BRIEF DESCRIPTION

In one aspect, an article may include a base layer and a first strand with a thermoplastic polymer material. The first strand may be embroidered with the base layer. The thermoplastic polymer material of the first strand may at least partially adhere to the base layer.

The base layer may include a layer of knitted material.

The first strand may be embroidered with the base layer after forming the base layer.

The base layer may include a textile layer and may be at least partially formed of a yarn with a material other than the thermoplastic polymer material.

The article may include the first strand and a second strand embroidered with the base layer, where the first strand has more of the thermoplastic polymer material per unit of length than the second strand.

The article may include the first strand and a second strand embroidered with the base layer, where the first strand and the second strand overlap at least at one area of the base layer.

At least two yarns of the base layer, and/or at least two portions of one yarn of the base layer, may be adhered to one another by the thermoplastic polymer material.

The base layer may include a first yarn and a second yarn, where the thermoplastic polymer material from the first strand adheres the first yarn to the second yarn.

The article may be an upper for an article of footwear.

The article may be an article of apparel.

The first strand may be embroidered with the base layer at a first embroidered area, where at least one of the first strand and a second strand are embroidered with the base layer at a second embroidered area, where the first embroidered area has a first degree of a mechanical property, and where the second embroidered area has a second degree of the mechanical property that is different than the first degree of the mechanical property.

The first degree of the mechanical property may be a first stretchability in a direction, where the second degree of the mechanical property is a second stretchability being less than the first stretchability in the direction.

The base layer may be a layer of mesh.

The article may have a skin layer located on the base layer.

The first strand may be substantially formed of the thermoplastic polymer material.

The base layer may include at least one yarn, where the at least one yarn includes a thermoplastic polymer material.

The thermoplastic polymer material may be applied to the base layer after the first strand is embroidered with the base layer.

BRIEF DESCRIPTION OF THE DRAWINGS

FIG. 5 shows a portion of an article having four embroidered strands; and

FIG. 6 shows the portion of the article of FIG. 5 where heat has been applied to at least a first embroidered strand and a second embroidered strand.

DETAILED DESCRIPTION

Figure 1:
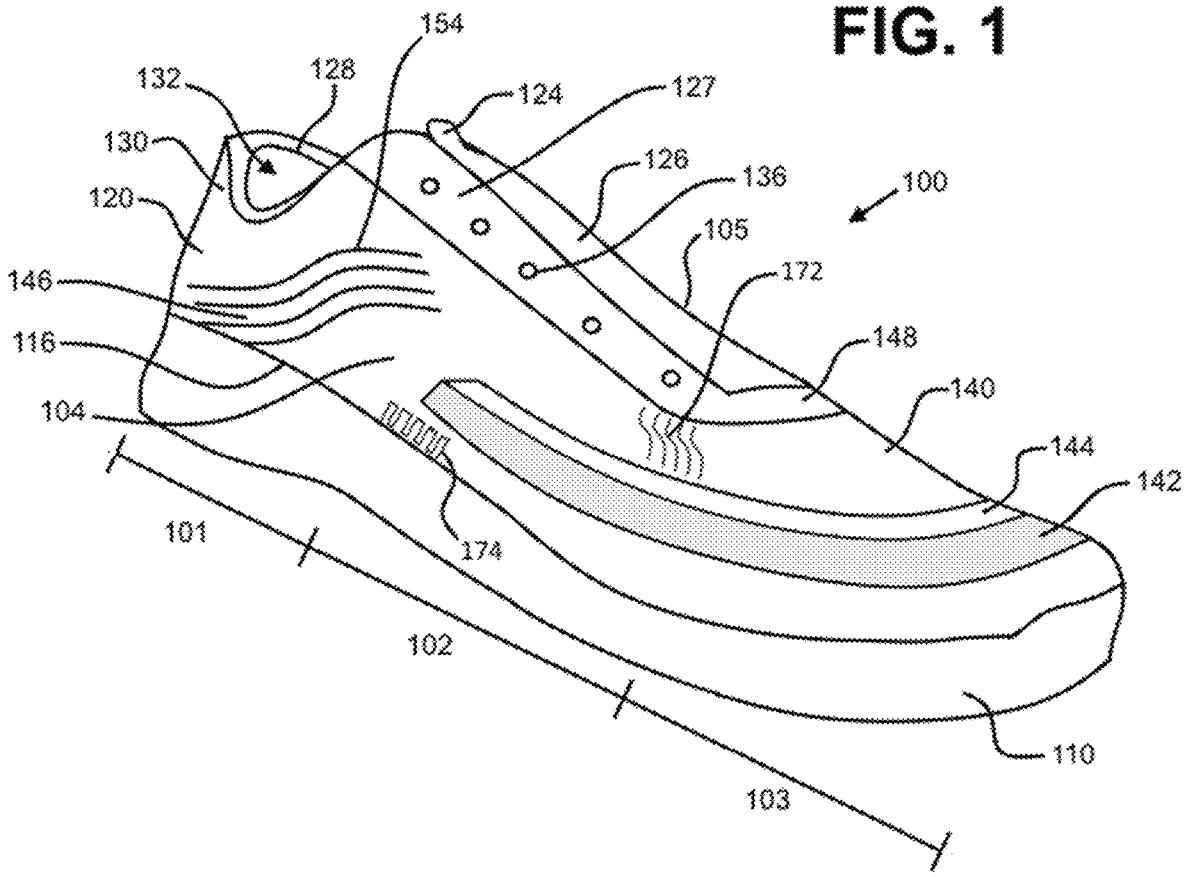
FIG. 1 shows an isometric view of an article of footwear with an upper having at least one embroidered areas.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to articles at least partially formed from textiles. One example of an article is an article of apparel (e.g., shirts, pants, socks, footwear, jackets and other outerwear, briefs and other undergarments, hats and other headwear, or the like). One example of an article is an upper configured for use in an article of footwear. An upper may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The upper may also be incorporated into a non-athletic shoe, such as a dress shoe, a loafer, and a sandal.

Referring to FIG. 1, an article of footwear 100 is generally depicted as including a sole 110 and an upper 120. The upper 120 includes a lateral side 104, a medial side 105, and a heel region 101. The area of the shoe where the sole 110 joins the upper 120 may be referred to as the biteline 116. The upper 120 may be joined to the sole 110 in a fixed manner using any suitable technique, such as through the use of an adhesive, by sewing, etc. It is contemplated that the upper 120 may extend partially or completely around the foot of a wearer and/or may be integral with the sole, and a sockliner may or may not be used.

In some embodiments, the sole 110 includes a midsole (not shown) and an outsole. The article of footwear 100 may additionally comprise a throat 126 and an ankle opening 128, which may be surrounded by a collar 130 and may lead to a void 132. The void 132 of the article of footwear 100 may be configured to accommodate a foot of a person. The throat 126 is generally disposed in the mid-foot region 102 of the upper 120. The mid-foot region 102 is generally a section of the upper 120 located between the heel region 101 and a toe region 103.

In FIG. 1, a tongue 124 is disposed in the throat 126 of the shoe, but the tongue 124 is an optional component. The tongue 124 may be any type of tongue, such as a gusseted tongue or a burrito tongue. If a tongue is not included, the lateral and medial sides of the throat 126 may be joined together, for example. Although not shown, in some embodiments, the article of footwear 100 may include an optional fastening element, such as a lace (which may be associated with the lace apertures 136). Any suitable type of fastening element may be used.

As depicted in FIG. 1, the upper 120 may include a base layer, which is depicted herein as a textile layer, but the base layer is not necessarily limited to textile materials. The base layer 140 may be formed of a knitted material, a woven material, one or more layers of mesh, a solid material, and/or any other suitable material. The base layer 140 may comprise one or more strands, threads, yarns, mesh components, or the like (herein referred to as a "yarn" when referring to a textile layer). The base layer 140 may have a first side forming an inner surface of the upper (e.g., facing the void of the article of footwear) and a second side forming an outer surface of the upper. In some embodiments, another object or layer, such as a cushioning layer, may be included between the void and the base layer 140. The base layer 140 may be formed as an integral one-piece element. For example, the base layer 140 may include a knitted component formed during a single weft knitting process (e.g., with a flat knitting machine or circular knitting machine), a warp knitting process, or any other suitable knitting process such that the knitting process substantially forms the knit structure of the base layer 140 without the need for significant post-knitting processes or steps. The upper 120 may further include a skin layer 148, for example near the throat 126 as shown. The skin layer 148 may reinforce certain areas of the upper 120, to inhibit stretch, enhance wear-resistance or abrasion resistance, etc. The skin layer 148 may be formed of a thermoplastic polymer material (e.g., thermoplastic polyurethane) and may be applied to the upper 120 in any suitable manner (e.g., by printing, pressing, spraying, or the like). While not shown, in some embodiments, the base layer 140 of the upper 120 may be configured to substantially surround the foot of a wearer.

The upper 120 or other article (e.g., an article of apparel) may have at least one embroidered area. For example, referring to FIG. 1, the upper 120 may include a first embroidered area 142, a second embroidered area 144, and a third embroidered area 146. An embroidered area may be an area of the base layer 140 with at least one embroidered element, such as a strand, thread, yarn, or the like (herein referred to as a "strand" when referring to an embroidered element). While the embroidered element will hereafter be referred to as a strand, it is contemplated that it could be an object other than a strand.

The embroidered strand may be embroidered with (e.g., into) the base layer 140 by an embroidery process. For example, in some embodiments, conventional embroidery machines (such as a single or multi-head embroidery machine as sold by Barudan America Inc. of Solon, Ohio) may form patterns or designs on the base layer 140 with the embroidered strand by stitching the embroidered element to and/or through the textile structure of the base layer 140 (e.g., through the use of satin-stitches, running-stitches, fill-stitches, or the like). Each stitch may utilize a lock-stitch or other structure to secure the embroidered strand to the base layer 140. In some embodiments, the embroidery process may take place substantially after the base layer 140 is formed (e.g., after the completion of a knitting process).

Figures 2, 3:
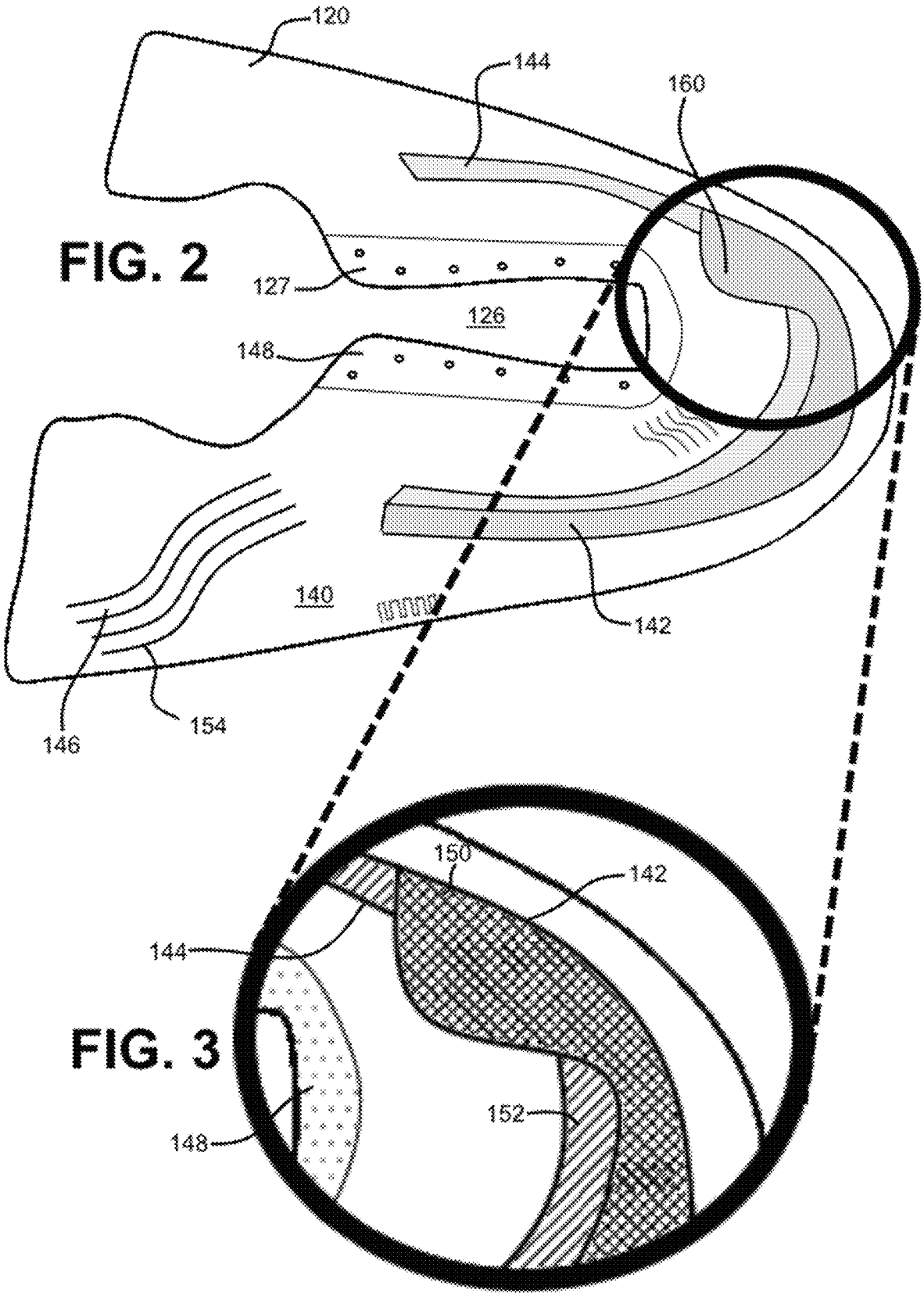
FIG. 2 shows an upper configured for use in the article of footwear of FIG. 1.
FIG. 3 shows a magnified view of an area of the upper of FIG. 2.

FIG. 2 shows one embodiment of the upper 120 in isolation, for example, prior to being combined with other elements (e.g., a sole structure) to form the completed article of footwear 100 of FIG. 1. As depicted, the upper includes the base layer 140, which may substantially form the upper 120. The base layer 140 may be embroidered at embroidered area 142, embroidered area 144, and/or embroidered area 146. The embroidered areas 142, 144, and/or 146 may be formed on the upper 120 prior to when the upper 120 is shaped (e.g., prior to being folded, attached to a strobel, and/or being placed over a foot-shaped last to obtain its final shape for use in an article of footwear). Advantageously, embroidering the base layer 140 of the upper 120 prior to shaping the upper 120 may simplify the embroidery process, particularly when the base layer 140 is substantially flat after its initial formation (e.g., on a flat-knitting machine).

FIG. 3 shows a close-up view of a portion of the upper 120 depicted by FIG. 2 to illustrate two different embroidered areas. As illustrated by FIG. 3, the first embroidered area 142 may have a first embroidery pattern and the second embroidered area 144 may have a second embroidery pattern. Herein, an "embroidery pattern" may refer to the particular location and/or sequence of the embroidered strands with the base layer 140, the size of the embroidered strand used, the type of embroidered strand used (including the material and color used), the number of embroidered strands used, the density of the embroidered strands (e.g., the number of strands per unit length in a direction perpendicular to the longitudinal axis of the strands), the state of the materials of the embroidered strands (for example, when the same embroidered strands are heat-processed differently), or the like. In this particular illustrated embodiment, the first embroidery pattern of the first embroidered area 142 is depicted as including a first strand 150 (which may be a continuous strand or a plurality of strands) and a second strand 152. The first strand 150 may extend into the second embroidered area as shown. The first strand 150 generally extends in a first direction at a plurality of locations within the first embroidered area 142 and continues in that first direction into the second embroidered area 144. The second strand 152 may extend in a second direction which may be (but is not necessarily) perpendicular to the first direction. In the depicted embodiment, the second strand 152 terminates or changes directions such that it does not extend into the second embroidered area 144. The first strand 150 and the second strand 152 may be identical, or they may be formed of different materials, may be different sizes, may have different visual properties or different mechanical properties, etc. Further, in embodiments where a plurality of strands form what is depicted as first strand 150, the plurality of strands may include a variety of strands having a variety of properties.

Figure 4:
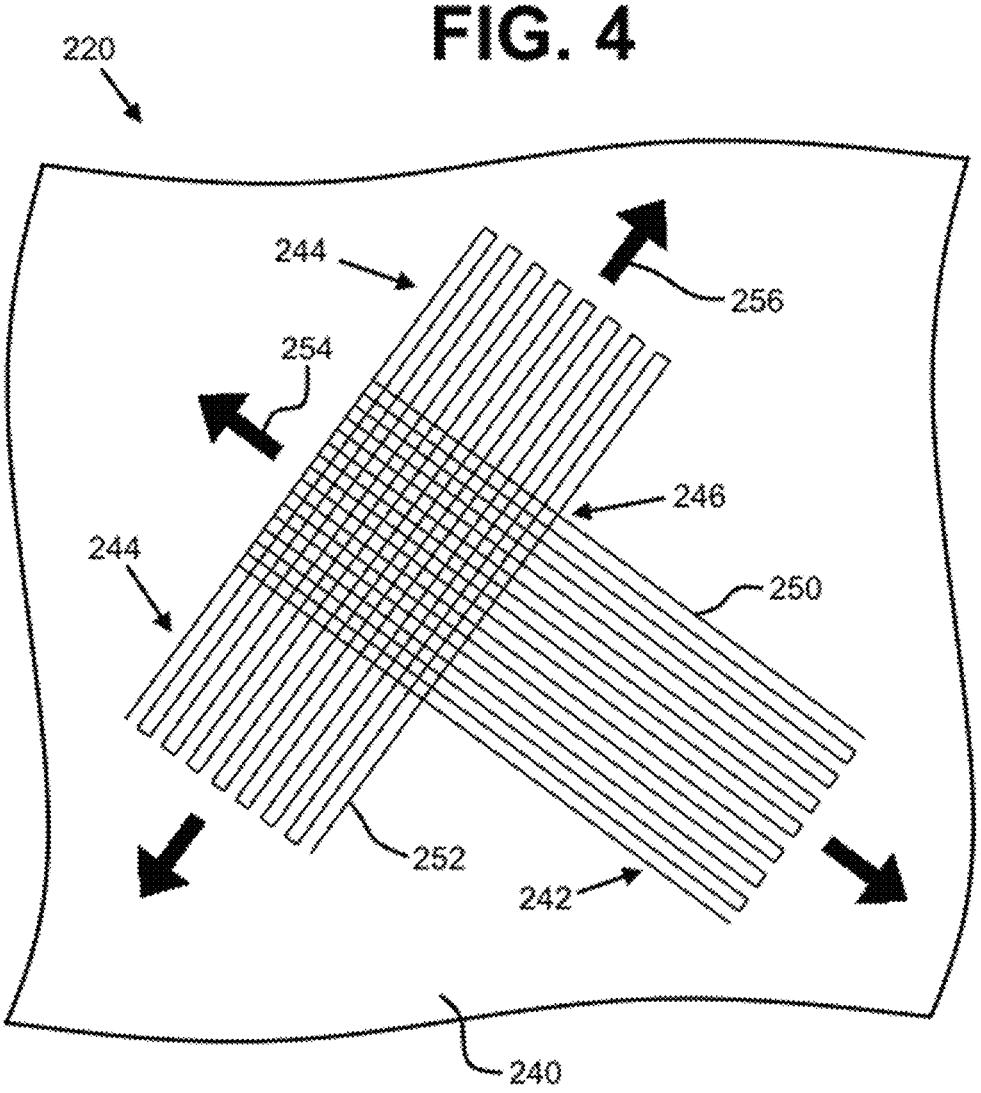
FIG. 4 shows an article having two embroidered strands and three embroidered areas.

Accordingly, different embroidered areas may be configured with different properties (e.g., different mechanical properties, different degrees of a certain mechanical property, or different visual properties). To illustrate, FIG. 4 shows an article 220 (e.g., an article of apparel) having a textile layer 240 with a first embroidered area 242, a second embroidered area 244, and a third embroidered area 246. A first strand 250, which may primarily extend in a first direction 254, may be embroidered with the textile layer 240 to form the first embroidered area 242. Similarly, a second strand 252, which may primarily extend in a second direction, may be embroidered with the textile layer 240 to form the second embroidered area 244. The third embroidered area 246 may incorporate both the first strand 250 and the second strand 252. Advantageously, the embroidered areas may exhibit different properties. For example, when the first strand 250 is relatively inelastic with respect to the underlying textile layer 240, the first embroidered area 242 may exhibit less stretchability in the first direction 254 than in the second direction 256. Similarly, when the second strand 252 is relatively inelastic with respect to the underlying textile layer 240, the second embroidered area 246 may exhibit less stretchability in the second direction 256 than in the first direction 254. The third embroidered area 246 may be relatively inelastic in both the first direction 254 and the second direction 256.

Embroidered areas may additionally or alternatively be configured to exhibit other selected properties, such as a desirable degree of stretchability, flexibility, durability, breathability, weight (as compared to a skin layer), permeability, water-resistance, water repellence, or any other property. Advantageously, the embroidered areas with certain properties may be selectively placed on an article (such as the article 220 of FIG. 4 or the upper 120 of FIGS. 1-3) such that the article is optimized for certain functions. To illustrate, referring to FIGS. 1-3, the third embroidered area 146 may include the third strands 154, which are depicted as being substantially larger (e.g., having a larger denier) than the first strand 150 and the second strand 152, which may be advantageous for providing a relatively high degree of structural integrity and/or a low degree of stretchability in at least one direction (assuming the larger denier is associated with increased strength and decreased elasticity, which may not be the case in all instances). In other embodiments, the third strands 154 may have a smaller denier than strands located elsewhere. For example, it is contemplated that embroidered strands having a relatively large denier may be located near the biteline 116 due to the tendency for the biteline 116 to experience wear, damage, and/or moisture. The third strands 154 may be placed at an area of the upper 120 that typically experiences high tension (e.g., between the biteline 116 and the throat 126). It is contemplated that the third strands 154 may extend from the biteline 116 and towards the throat 126 and to a throat area 127.

The upper 120 may have any number of embroidered areas. Referring to FIG. 1, a fourth embroidered area 172 may be located adjacent to the throat area, which may be advantageous for addition support and desirable flexibility and/or stretchability in that location. The fifth embroidered area 174 is shown adjacent to the biteline 116. This may be particularly advantageous when the fifth embroidered area 174 includes a high degree of water repellence or water resistance due to the tendency of the biteline 116 and adjacent area to come into contact with moisture. The fifth embroidered area 174 may additionally or alternatively include strands having a relatively high strength (for example by having a high denier or a relatively strong material), which may be advantageous due to the tendency for damage and/or wear to occur near the biteline 116. It is contemplated that the fifth embroidered area 174 may be located adjacent to the biteline 116 for the entirety of the biteline 116 (e.g., it may substantially circumnavigate the article of footwear 100).

Additionally, the upper 120 may include the first embroidered area 142 which may be relatively durable, inelastic (i.e. having a low stretchability), and strong when compared to the second embroidered area 144, and may be located in locations that are prone to damage and/or wear, such as the area corresponding to the ends of the toes of a person wearing the article of footwear. For example, the depicted embodiment shows the first area 142 as including a hallux portion 160 which is configured to associate with the area of the upper 120 that covers the hallux (also known as the "big toe") of a person, which is an area of an upper that may commonly wear out and/or become damaged. Other areas, such as the second embroidered area 144, may be embroidered to exhibit lesser degrees of the desirable properties of the first embroidered area 142 (and/or different properties) as needed or desired, which may be advantageous when optimizing the amount of certain materials in certain areas of an article (e.g., to control or prohibit excessive costs).

In some embodiments, at least one of the strands embroidered with the base layer 140 may be at least partially formed of at least one thermoplastic polymer (collectively "the thermoplastic polymer material"). Illustrative, non-limiting examples of thermoplastic polymers include polyurethanes, polyamides, polyolefins, and nylons. In contrast to thermoset polymeric materials (described below), thermoplastic polymers melt when heated and return to a solid state when cooled. More particularly, a thermoplastic polymer transitions from a solid state to a softened or liquid state when subjected to temperatures at or above its melting point, and then the thermoplastic polymer transitions from the softened or liquid state to a solid state when sufficiently cooled. The embroidered strands may have one or more thermoplastic polymers. To illustrate, substantially the entirety of the embroidered strands may be formed of the thermoplastic polymer material. In one non-limiting example, the embroidered strands may be a yarn with a core made of a polyester (and/or another thermoset material or thermoplastic polymer material with a relatively high melting point) a thermoplastic polymer sheath. The thermoplastic polymer material of the sheath may have a melting temperature less than the melting temperature or decomposition temperature of the polyester core. For example, the melting temperature of the thermoplastic polymer material may have a melting temperature of approximately 100° C. less than the melting temperature of the polyester core in some embodiments, though any other suitable difference in melting temperatures is contemplated. The melting temperature of the polyester core may be about 260° C., and the decomposition temperature may be about 350° C. or greater. The melting temperature of the thermoplastic polymer may be, for example, between about 80° C. and about 140° C., such as from about 100° C. to about 125° C. based on atmospheric pressure at sea level. The embroidered strands may specifically be a yarn marketed as a DREAM SIL thermoplastic polyurethane coated yarn manufactured by Sambu Fine Chemical Co., LTD.

In contrast, when the base layer is a textile layer, the yarns forming the base layer 140 may be substantially formed of a material that has a melting point (e.g., if it is a thermoplastic polymer material) and/or a decomposition point (e.g., if it is a thermoset material) that is higher than the melting point of the embroidered strands. Illustrative, non-limiting examples of materials that may form the yarns of the base layer 140 may include thermoset polymeric materials and natural fibers such as cotton, silk, and wool, or thermoplastic polymer materials with a relatively high melting point, such as a polyester. When subjected to moderate levels of heat (e.g., up to 200° C. or more), these materials tend to remain stable. Moreover, when subjected to elevated levels of heat, thermoset polymeric materials and natural fibers may burn or otherwise degrade or decompose, and thermoplastic polymer materials with a relatively high melting point (like polyester) may soften and/or melt. In some embodiments, the melting point or decomposition temperature of the yarns forming the base layer 140 is greater than about 140° C. based on one atmosphere pressure, such as more than 200° C. For example, if the yarns forming the base layer 140 include a polyester, they may have a melting point of about 250° C. and a boiling or decomposition point of about 350° C.

It is contemplated that the yarns forming the base layer 140 may include a thermoplastic polymer material along with strands embroidered therein and also when strands embroidered therein are not configured to at least partially melt during heat processing. It is also contemplated that neither the yarns forming the base layer 140 nor the strands embroidered therein include a thermoplastic polymer material for heat-processing, but rather the thermoplastic polymer material may be added (e.g., sprayed, printed, or the like). For simplicity, the embodiments described herein generally refer to the thermoplastic polymer material with a melting point for heat-processing with moderate levels of heat (e.g., below 200° C. in some embodiments) being included only with embroidered strands.

Incorporating a thermoplastic polymer material with an appropriate melting point into an embroidered strand is advantageous for achieving several properties that are desirable in certain environments. For example, the application of heat to melt at least a portion of an embroidered strand may cause the embroidered strand to adhere to the yarns forming the base layer 140 and/or to other embroidered strands. The thermoplastic polymer material may further permeate or otherwise move through the base layer 140 when melted to thereby adhered at least two yarns forming the base layer 140, and/or at least two portions of one yarn forming the base layer 140, to one another. Advantageously, this may create a structure that has desirable strength, rigidity, and stretchability. This may additionally or alternatively secure certain yarns of the base layer 140, certain embroidered strands, and/or certain other objects in a desired orientation. Further, the melted and hardened thermoplastic polymer material may be utilized to form waterproof or water-resistant areas within the article, or even airproof or air-resistant areas. The embroidered strands may additionally or alternatively be manipulated while melted to achieve various desirable aesthetic effects (e.g., to form visually-pleasing textures).

FIG. 5 shows a portion of an article with a textile layer 340 and four embroidered strands. The first strand 352 and the second strand 354 may be at least partially of a thermoplastic polymer material. The first strand 352 and the second strand 354 are shown as overlapping the third strand 356 and the fourth strand 358. In other embodiments (or in another location of the textile layer 340 in this embodiment), the first strand 352 may additionally or alternatively overlap the second strand 354 at least at one area. For example, the first strand 352 may be formed of a polyester yarn with a coating of a thermoplastic polymer material with a melting point lower than polyester. The second strand 354 may be formed substantially of a thermoplastic polymer material with a melting point lower than polyester. The yarns forming the textile layer 340 and/or the embroidered strands 356 and 358 may be formed of a thermoset material or other material that does not melt at the melting temperature of the thermoplastic polymer material of at least one of the first strand 352 and the second strand 354.

FIG. 6 shows the portion of the article of FIG. 5 after the application of heat to the first strand 352 and the second strand 354 such that the first strand 352 and the second strand 354 at least partially melted and have cooled to a solid state. Heat may be applied, for example, with the use of a heat press. The heat may be applied to the entire article, or it may be concentrated at certain areas of the article. The first strand 352 is shown as having fused to the yarns of the textile layer 340 that were adjacent to it prior to the application of heat. However, because the first strand 352 includes a core of a material other than the thermoplastic polymer material of its sheath, the first strand 352 includes relatively little thermoplastic polymer material, at least when compared to a strand formed fully of the thermoplastic polymer material (e.g., second strand 354). In other words, the second strand 354 may include more thermoplastic polymer material per unit of length than the first strand 352. Accordingly, as depicted in FIG. 6, the limited amount of melted thermoplastic polymer material of the first strand 352 may not permeate or otherwise move far from the original location of the first strand 352 (at least with respect to second strand 354). In some embodiments, it may not even be visually apparent that the thermoplastic polymer material of the first strand 352 moved when viewing a sample before and after the application of heat. For example, the displacement of the thermoplastic polymer from the first strand 352 after the application of heat may be less than 1 millimeter.

Advantageously, the first strand 352 may have desirable characteristics associated with the thermoplastic polymer material (e.g., the first strand 352 adheres to the yarns forming the textile layer 340) without sacrificing breathability, stretchability, and/or other mechanical property (which is construed to mean any functional property) or aesthetic properties associated with the textile layer 340. For example, specifically referring to breathability for purposes of illustration, the breathability of an area of an article having an embroidered area with an embroidered strand that has been at least partially softened with heat and then cooled into a hardened state may exhibit a greater breathability than an otherwise comparable area that instead uses a skin layer and/or a layer of printed film.

The second strand 354, on the other hand, is depicted as being fully formed of a thermoplastic polymer material. When heat is applied, the thermoplastic polymer material of the second strand 354 may fully melt and may permeate or otherwise move a relatively far distance from the original location of the second strand 354. In some embodiments, the thermoplastic polymer from the second strand 354 may be displaced after the application of heat by greater than 0.5 millimeters, by greater than 1 millimeter, by greater than 3 millimeters, or by 5 millimeters or more. This may be advantageous when it is desired to produce a relatively large area of fused material, for example in areas or environments where the yarns of the textile layer 340 are particularly prone to wear or damage (e.g., by snagging), where waterproof or water resistance is desired, etc.

Embroidered strands may be configured to have an optimal amount of thermoplastic polymer material to achieve particular characteristics by varying the size of the strands, by varying the size of a core and/or sheath (e.g., where the sheath has a lower melting point than a melting point or decomposition point of the core), of the strands and/or the thickness of the coating (i.e., the thermoplastic polymer sheath), by selecting the amount of heat applied during the heat-application step, by selecting the proximity of one embroidered strand to another, by selecting the type of thermoplastic polymer materials used, or the like (and a combination thereof).

All of the structures and methods disclosed and claimed herein can be made and executed without undue experimentation in light of the present disclosure. While this invention may be embodied in many different forms, several specific aspects of the invention are described in detail herein. The present disclosure is an exemplification of the principles of the invention and is not intended to limit the invention to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various aspects described herein. It should also be understood that various changes and modifications to the aspects described herein will be apparent to those skilled in the art. Such changes and modifications can be made without departing from the spirit and scope of the invention and without diminishing its intended advantages. It is therefore intended that such changes and modifications be covered by the appended claims.

We claim:

1. An article, the article comprising:

a base layer; and a first strand embroidered with the base layer at a first embroidered area, wherein the first strand includes an elasticity that is less than an elasticity of the base layer, and wherein the first strand includes a plurality of first lengths that extend in a first direction such that the first embroidered area of the article includes a first elasticity along the first direction, wherein the first embroidered area of the article includes a second elasticity in a second direction, wherein the second direction is perpendicular to the first direction, and wherein the second elasticity is greater than the first elasticity.

2. The article of claim 1, further comprising:

a second embroidered area, wherein a second strand is embroidered with the base layer at the second embroidered area, and wherein the second strand includes a plurality of second lengths that extend in a direction that is different from the first direction.

3. The article of claim 2, wherein the plurality of second lengths of the second strand of the second embroidered area extend in the second direction.

4. The article of claim 3, wherein further comprising:

a third embroidered area, wherein the third embroidered area includes at least one of the first lengths extending in the first direction and at least one of the second lengths extending in the second direction.

5. The article of claim 4, wherein the at least one of the first lengths and the at least one of the second lengths overlap in the third embroidered area.

6. The article of claim 1, wherein the base layer includes a layer of knitted material.

7. The article of claim 1, wherein the first strand includes a thermoplastic polymer material.

8. The article of claim 7, wherein the base layer includes a textile layer and is at least partially formed of a yarn comprising a material other than the thermoplastic polymer material.

9. The article of claim 7, wherein the first strand is secured to the base layer via fusing of the thermoplastic polymer material.

10. The article of claim 1, wherein the article is an upper for an article of footwear.

11. An article, the article comprising:

a base layer formed with a plurality of knitted loops; and a first strand embroidered with the base layer at a first embroidered area, wherein the first strand includes a plurality of stitches extending at least partially through the base layer, and wherein the first strand includes a plurality of first lengths that extend in a first direction such that the first embroidered area of the article includes a first elasticity along the first direction, wherein the first embroidered area of the article includes a second elasticity in a second direction, wherein the second direction is perpendicular to the first direction, and wherein the second elasticity is greater than the first elasticity.

12. The article of claim 11, further comprising:

a second embroidered area, wherein a second strand is embroidered with the base layer at the second embroidered area, and wherein the second strand includes a plurality of second lengths that extend in a direction that is different from the first direction.

13. The article of claim 12, wherein the plurality of second lengths of the second strand extend in the second direction.

14. The article of claim 13, wherein further comprising:

a third embroidered area, wherein the third embroidered area includes at least one of the first lengths extending in the first direction and at least one of the second lengths extending in the second direction.

15. The article of claim 14, wherein the at least one of the first lengths and the at least one of the second lengths overlap in the third embroidered area.

16. The article of claim 11, wherein the base layer includes a layer of knitted material.

17. The article of claim 11, wherein the first strand includes a thermoplastic polymer material.

18. The article of claim 17, wherein the base layer includes a textile layer and is at least partially formed of a yarn comprising a material other than the thermoplastic polymer material.

19. The article of claim 17, wherein the first strand is secured to the base layer via fusing of the thermoplastic polymer material.

20. An article, the article comprising:

a base layer formed with a plurality of knitted loops; and a first strand embroidered with the base layer at a first embroidered area;

a second strand embroidered with the base layer at a second embroidered area, wherein the first strand includes a plurality of stitches extending at least partially through the base layer, wherein the second strand includes a plurality of stitches extending at least partially through the base layer, wherein the first embroidered area has a first elasticity in a first direction and a second elasticity in a second direction, wherein the second embroidered area has a third elasticity in the first direction and a fourth elasticity in the second direction, wherein the first elasticity is greater than the second elasticity, and wherein the fourth elasticity is greater than the third elasticity.

* * * * *